United States Patent [19]

Styck

[11] 4,343,588

[45] Aug. 10, 1982

[54] KICKOUT BUCKET POSITIONER

[75] Inventor: Wayne G. Styck, Bettendorf, Iowa

[73] Assignee: Caterpillar Tractor Co., Peoria, Ill.

[21] Appl. No.: 250,748

[22] PCT Filed: Jul. 10, 1980

[86] PCT No.: PCT/US80/00885

§ 371 Date: Jul. 10, 1980

§ 102(e) Date: Jul. 10, 1980

[87] PCT Pub. No.: WO82/00310

PCT Pub. Date: Feb. 4, 1982

[51] Int. Cl.[3] ..... E02F 3/86

[52] U.S. Cl. ..... 414/701; 91/358 A; 74/519; 172/466

[58] Field of Search ..... 414/697, 699, 701, 714; 37/DIG. 1; 172/465, 466; 91/358 A; 74/516, 519, 522.5

[56] References Cited

U.S. PATENT DOCUMENTS 4,020,963 5/1977 Carter ..... 414/699

4,024,974 5/1977 Hodge ..... 414/699

*Primary Examiner*—Edward R. Kazenske

*Assistant Examiner*—Terrance L. Siemens

*Attorney, Agent, or Firm*—Phillips, Moore, Weissenberger, Lempio & Majestic

[57] ABSTRACT

The previous linkages for transmitting signals across an axis (21) between a first member or cylinder (20) and a second member or frame (11) have been relatively difficult to adjust and have had a tendency to bind. Herein, a roller (44) is pivotally mounted to a first link structure (36) which is itself pivotally mounted relative to the cylinder (20). The roller (44) defines a generally circular cam surface (42). A second link structure (52) is mounted to the frame (11) and a generally U-shaped member (98) has one of its legs (100) mounted to the second link structure (52) and the other leg (102) positioned to define a coacting surface (106) for action against the roller (44). An adjustment device (122) serves for adjusting the other leg (102) of the generally U-shaped member (98) tangentially and radially relative to the roller (44). Relatively straightforward and easily accessible adjustment is thereby provided. Also, binding problems are reduced.

7 Claims, 5 Drawing Figures

KICKOUT BUCKET POSITIONER

TECHNICAL FIELD

This invention relates generally to a linkage means for transferring a mechanical signal across a pivot axis connecting a first member to a second member and more particularly to a linkage means for a bucket positioner system for a loader vehicle.

BACKGROUND ART

Conventional loader vehicles are adapted to perform various digging, loading and carrying operations during a cycle of loader operation. During certain phases of the loading operation, such as rack-back of the bucket after it has been loaded, it is desirable to provide means to continue the rack-back action, once such action is initiated by the operator, and to stop such action automatically when the bucket arrives at a predetermined position. Such automatic operations are generated typically by devices called, respectively, detent means and detent release means. They allow an operator to be free to direct his attention elsewhere, as needed. Release means have included various cable coupling schemes for transferring a detected degree of extension of a tilt cylinder rod to a detent release control means. Such coupling structures generally include flexible control cables that couple, either hydraulically or mechanically, control signals to the detent release control means. Flexibility is required because the tilt cylinder pivots with respect to the loader vehicle operator controls.

One particular linkage means for transferring a signal across the pivot axis between the tilt cylinder and the frame which does not utilize a flexible control cable is set out in U.S. Pat. No. 4,020,963, issued May 3, 1977 to Carl W. Carter. In the linkage means of that patent, a circular cam, having a centerline generally in line with the pivot axis between the cylinder and the frame, is carried by a first lever which is pivotally mounted relative to the cylinder, with the cam surface bearing against a coacting surface on a second lever which is pivotally mounted relative to the frame. In such apparatus, the adjustment of the linkage is provided by a bolt which extends through a tapped hole in the first lever. The sliding contact between the bolt and the lever can cause the linkage to bind. Also, since the kickout occurs at the maximum movement of the roller, sufficient force is not always provided to overcome such binding and to transmit movement to the second lever. Further, the location of the bolt is such that adjustment is not easily made.

The present invention is directed to overcoming one or more of the problems as set forth above.

DISCLOSURE OF THE INVENTION

In one aspect of the present invention, an improvement is provided in an apparatus having first and second members which are pivotally mounted relative to one another about a pivot axis, the first member having first and second operating conditions. The apparatus has linkage means for transmitting a mechanical signal across the pivot axis, which linkage means has a first link structure pivotally mounted relative to the first member and defining a generally circular cam surface, the first link structure being pivotable to first and second positions relative to the first member. The apparatus also has a second link structure having first and second positions and being pivotally mounted relative to the second member, the second link structure defining a coacting surface which the cam surface contacts with the first link structure in its first position to define the first position of the second link structure. Means are provided for moving the second link structure to its second position in response to movement of the first link structure to its second position. Mechanical signal originating means serves for moving the first link structure to its first and second positions in response to the first member being respectively in its first and second operating conditions. The improvement of the present invention comprises a roller having a center and being mounted at its center to the first link structure, the roller defining the circular cam surface; a generally U-shaped member having a pair of legs having outfacing sides is mounted to the second link structure, one of the outfacing sides defining the coacting surface; and means for adjusting the generally U-shaped member tangentially and radially relative to the roller.

Utilizing an improvement as set out above, adjustment of the linkage is provided via adjustment of the U-shaped member. The adjusting means can be, for example, a bolt which passes through the U-shaped member and provides both the tangential and radial adjustment of the U-shaped member relative to the roller. The roller can also be positioned slightly overcenter whereby as play develops in the linkage with wear, kickout of the bucket will still occur in the required manner. Still further, adjustment of the linkage is relatively easy since it only requires adjustment of the adjusting means, for example, a bolt which passes through one leg of the U-shaped member and contacts the other leg thereof to provide a controllable contract force between the roller and the U-shaped member. The same bolt can serve for adjusting the U-shaped member axially relative to the second link structure. Thus, simple straightforward adjustment is possible via adjustment of an easily accessible single bolt. Further, the adjustability of the roller overcenter provides additional force for kickout after the desired kickout position is reached.

BEST MODE FOR CARRYING OUT THE INVENTION

Figure 1:
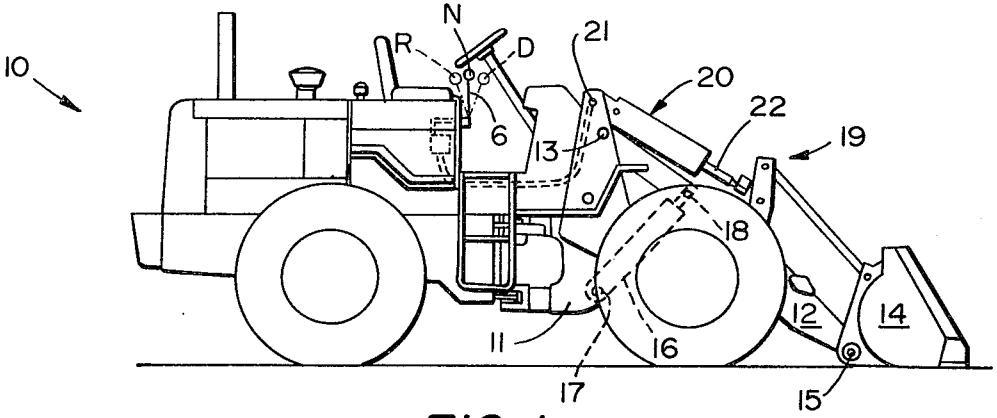
FIG. 1 illustrates, in a side elevational view, a loader vehicle employing apparatus in accordance with an embodiment of the invention.

FIG. 1 illustrates a loader vehicle 10 having a frame 11 having a pair of pivot arms 12 (one shown), each pivotally mounted thereon by a pivot pin 13. The lift arms 12 have a bucket 14 pivotally mounted on the forward ends thereof by laterally spaced pivot pins 15

(one shown). Although the hereinafter described positioner finds particular application to such a loader vehicle 10, it should be understood that this invention may be adapted for use in linkage systems for all types of machines.

Each lift arm 12 is adapted to be selectively raised or lowered by a pair of double-acting hydraulic cylinders 16 (one shown) pivotally mounted on frame 11 and the lift arms 12 by pivot pins 17 and 18, respectively. A standard tilt or bucket positioner means 19 is pivotally interconnected between the lift arms 12 and the bucket 14 to move the bucket 14 to a desired position. The tilt linkage 19 includes a hydraulically actuated double acting cylinder 20 pivotally mounted to the frame 11 by a pivot pin defining a pivot axis 21.

Cylinder 20 has a rod 22 reciprocally mounted therein to be selectively extended or retracted thereby. In the present embodiment, the extension of the rod 22 from the tilt cylinder 20 causes the bucket 14 to tilt forward into a "dump" attitude. Retraction of the rod 22 into the cylinder 20 causes the bucket 14 to tilt back in a rearward direction toward the vehicle 10. This attitude of the bucket 14 is termed "rack-back."

A typical operator control for actuating the cylinder 20 and thus controlling the position of the bucket 14 is a hand lever 6 connected to a hydraulic control valve 8 mounted on the frame 11. The valve 8 is typically of a spool type, spring centered to a neutral position (N) between the dump (D) and rack-back (R) command positions, with a detent and detent release mechanism at the R position. Thus, when the operator moves lever 6 towards the D position, the bucket 14 is caused by the tilt linkage means 19, including the tilt cylinder 20, to rotate forward until the operator releases lever 6, allowing the lever to spring return to its N position, or until the maximum dump angle of the bucket 14 is reached. When the operator moves lever 6 towards the R position, one of two results is possible. If the lever 6 is not moved completely back into the R command position, the rearward rotation of the bucket 14 will stop when the operator releases the lever 6 and allows the valve 8 to return to its N position. If the lever 6 is moved back fully to the R command position, the detent engages to hold the valve 8 at that position to thereby enable the bucket 14 to automatically continue to rotate in a rearward direction, or roll-back, without need for the operator to continue holding lever 6 in the R position. The bucket 14 will continue to rotate back until a detent release signal is detected by the valve 8, at which time the rack-back is automatically stopped. The detent release signal is usually produced by the automatic detection of a given retraction (or extension, if desired) of rod 22 in the tilt cylinder 20.

Note that rod 22 need not be fully retracted before the detent release signal is generated. Retraction of the bucket 14, beyond the point when a detent release signal is generated, is useful under the manual control of lever 6 only, since the bucket 14 in such a mode could be used to pry loose materials being excavated, for example, without the actuation of the detent means. This is because such excavation requires successive roll-back commands. It would be inefficient to constantly require the operator to release the detent means when the detent means can be kept off by the detent release signal.

The cylinder 20 can more generally be thought of as a first member and the frame 11 as a second member, which members are pivotally mounted relative to one another about the pivot axis 21. By reference to FIG. 2, it will be seen that the cylinder 20 has both a first operating condition 32 (corresponding to lever 6 being moved toward the D position) and a second operating condition 34 (corresponding to lever 6 being moved toward the R position). The first operating condition 32 is the dump position shown in FIG. 1 and the second operating condition 34 is the rack-back condition shown in FIG. 2.

Figure 2:
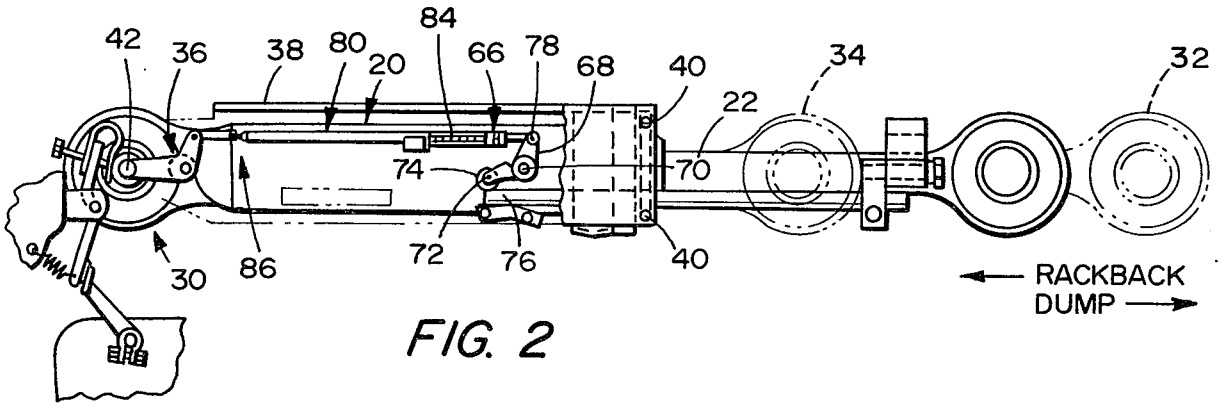
FIG. 2 illustrates, in enlarged side view, a tilt cylinder with linkage means installed thereon in accordance with an embodiment of the present invention.

As is set out in FIG. 2, linkage means 30 serves for transmitting a mechanical signal across the pivot axis 21 (seen in FIG. 1). The linkage means 30 includes a first link structure 36 which is pivotally mounted relative to the first member 20. More particularly, the first link structure 36 is pivotally mounted to a support 38 which is itself mounted to the cylinder 20 as at bolts 40. The first link structure 36 defines a generally circular cam surface 42 as part of a roller 44 which is mounted to a first end portion 46 of the first link structure 36. The first link structure 36 is pivotable to first 48 and second 50 positions relative to the cylinder 20, as illustrated in FIG. 3.

Figure 3:
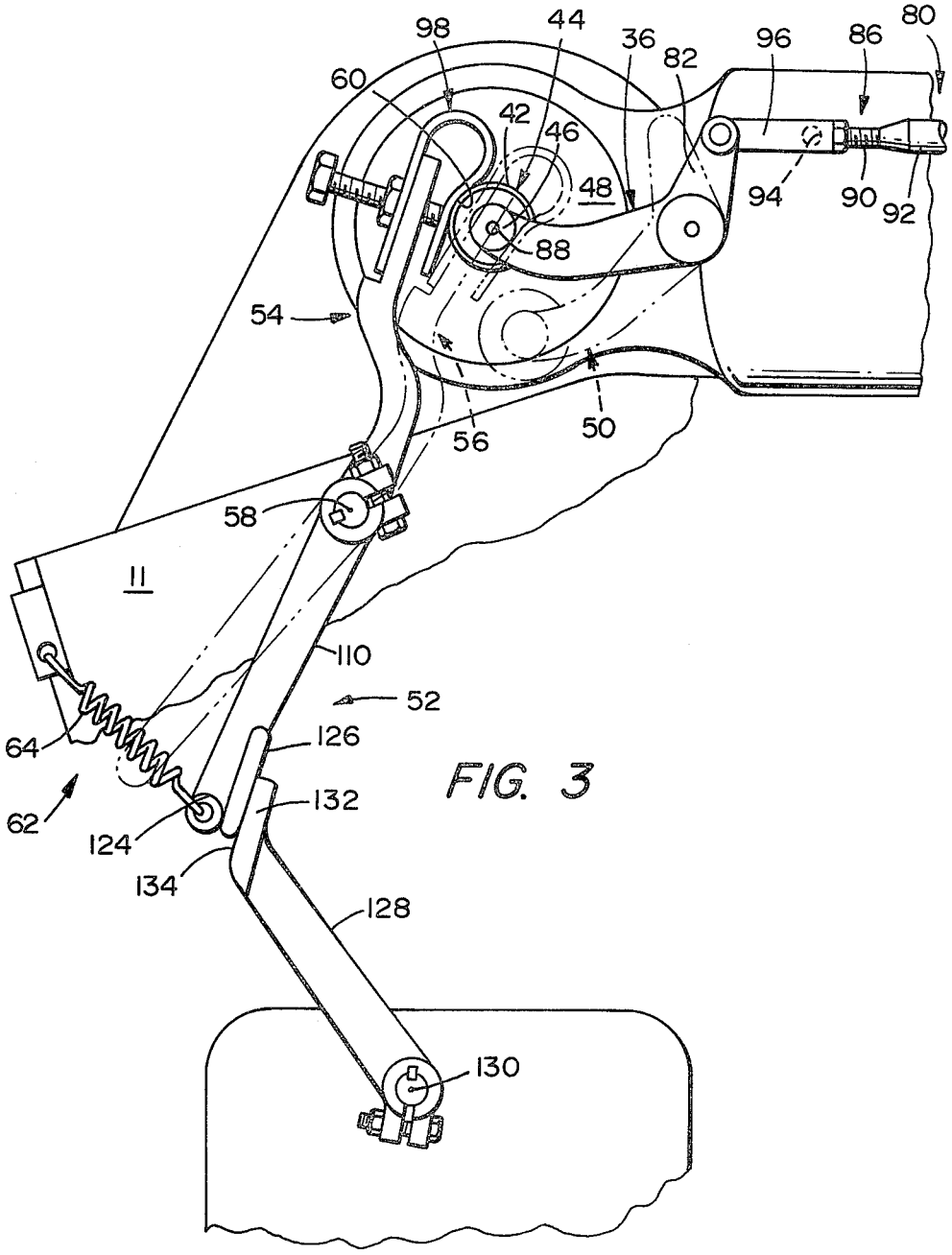
FIG. 3 illustrates, in further enlarged view, the improved linkage in accordance with an embodiment of the present invention.

A second link structure 52 has first 54 and second 56 positions, as is also illustrated in FIG. 3. The second link structure 52 is pivotally mounted at 58 relative to the frame 11. The second link structure 52 defines a coacting surface 60 which the cam surface 42 contacts with the first link structure 36 in its first position 48. This serves to define the first position 54 of the second link structure 52. Means 62 which, in the embodiment illustrated is a spring 64, serves for moving the second link structure 52 to its second position 56 in response to movement of the first link structure 36 to its second position 50.

Adverting to FIG. 2, mechanical signal originating means 66 are shown which serve for moving the first link structure 36 to its first 48 and second 50 positions in response to the cylinder 20 being respectively in its first 32 and second 34 operating conditions. The mechanical signal originating means 66 illustrated includes a lever 68 centrally pivotally mounted at a pivot 70 relative to the cylinder 20. A first end 72 of the lever 68 has a roller 74 which is positioned to be contacted by a bar 76 which moves axially with the rod 22 of the cylinder 20. A second end 78 of the lever 68 is connected to a rod structure 80, which is also pivotally connected to a second end portion 82 of the first link 36. When the cylinder rod 22 is in the position shown in FIG. 2, the roller 74 has been rotated clockwise due to contact with the bar 76. This serves to motivate the first lever 36 into the position shown in FIG. 2. When the cylinder rod 22 is extended to the dump position 32, the lever 68 rotates counterclockwise under the impetus of a spring 84 which acts between the second end 78 of the lever 68 and the rod 20, or more particularly the support 38. Thereby, the first link 36 is motivated into its second position 50.

The rod structure 80 (FIG. 3) includes means 86 for adjusting the first link structure 36 relative to the cylinder 20 for positioning a center 88 of the roller 44 a selected distance over the pivot axis 21. In the embodiment illustrated the means 86 comprises threads 90 on a first section 92 of the rod structure 80. As shown in FIG. 3, the rod structure 80 can be shortened to force the first link structure 36 to be biased somewhat in a clockwise direction whereby the roller 44 will be moved leftwardly and upwardly against the coacting surface 60. In the position illustrated in FIG. 3, the center 88 of the roller 44 is aligned with the pivot axis 21. When the threads 90 are threaded further into a cavity 94 of a bifurcated end 96, the center 88 of the roller 44 is positioned a slight selected distance overcenter, i.e., over the pivot axis 21. This provides a built in allowance for wear of various components of the linkage. That is, readjustment is not necessary until the center 88 of the roller 44 has been moved backward passed the pivot axis 21 due to wear on the various components. Since the center 88 of the roller 44 is very near the pivot axis 21 of the cylinder 20 to the frame 11, mechanical signals are translated over the pivot axis 21 within the limits of the operative pivot angles of the cylinder 20, regardless of the cylinder angular attitude.

Figure 4:
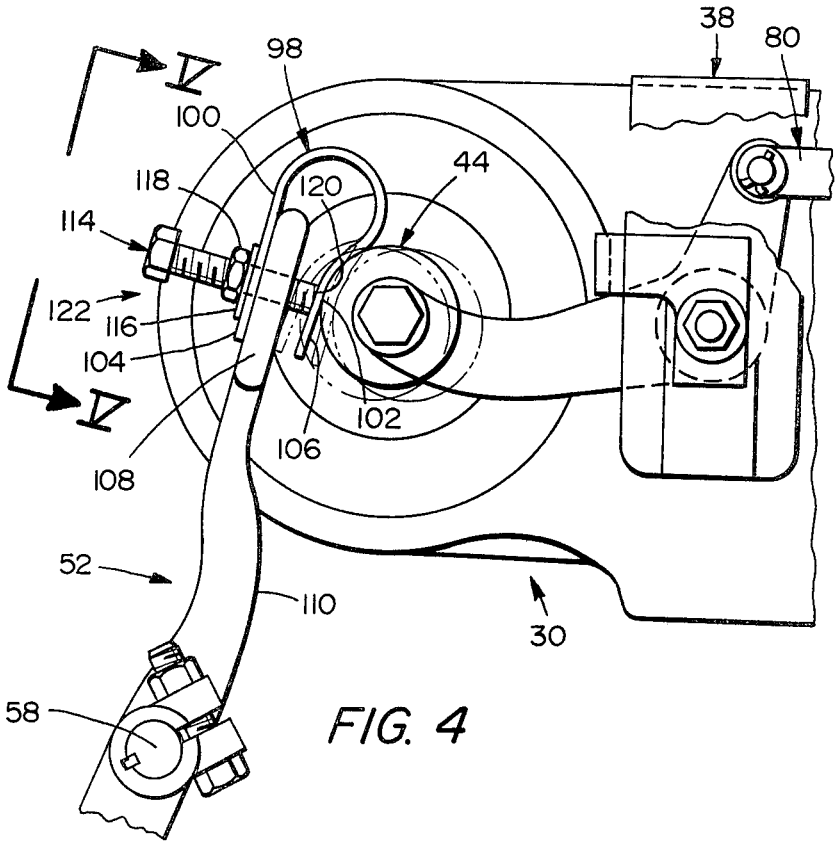
FIG. 4 illustrates, in still further enlarged view, improved apparatus in accordance with an embodiment of the invention.
Figure 5:
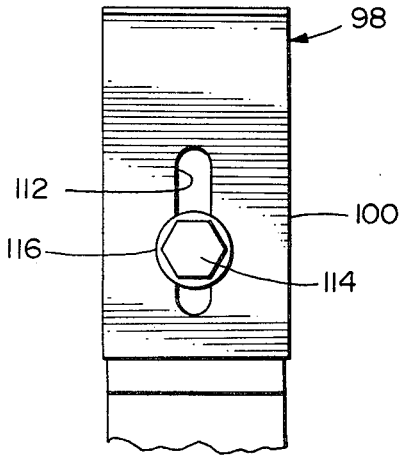
FIG. 5 illustrates, in partial view, a view taken along line V—V of FIG. 4, with all portions other than the generally U-shaped member and the lever to which it is mounted excluded.

In accordance with the present invention, a generally U-shaped member 98, preferably constructed of a metallic flat plate spring material and seen best in FIGS. 4 and 5, has a pair of legs 100 and 102 having outfacing sides 104 and 106 respectively. The generally U-shaped member 98 is mounted to the second link structure 52, more particularly to a first end portion 108 of a first lever 110 which is a part of the second link structure 52, and is generally centrally pivotally mounted to the frame 11 at 58. More particularly, the generally U-shaped member 98 is mounted with one of its legs 102 in contact with the roller 44 and with the other of its legs 100 mounted to the first end 108 of the first lever 110. The one leg 102 of the generally U-shaped member 98 is generally bent so as to generally match the shape of the roller 44.

The other leg 100 of the generally U-shaped member 98 has a slot 112 therein extending lengthwise through which an adjusting bolt 114 fits. An appropriate flat washer 116 is interposed between a locking nut 118 and the other side 100 of the generally U-shaped member 98 (see FIG. 4). Member 98 is thus extensible and retractable with respect to lever 110. In this manner, the adjusting bolt 114, which is threaded in the first end 108 of lever 110, can be advanced or retracted relative to the other leg 100 of the generally U-shaped member 98, thereby forcing an end 120 of the adjusting bolt 114 to bear against the one leg 102 of the generally U-shaped member 98 to force the side 106 of the generally U-shaped member 98 to closely conform with the shape of the roller 44. The locking nut 118 is then used to tightly secure member 98 and bolt 114 in place. Thus, a simple adjustment which is easily available, namely, the adjusting bolt 114 and nut 118, assures proper alignment of the various portions of the linkage means 30. Basically then, the adjusting screw 114 along with the slot 112, the washer 116 and the nut 118 serve as means 122 for adjusting the generally U-shaped member 98 tangentially and radially relative to the roller 44.

The previously discussed spring 64, which serves for biasing the second link structure 52 towards its second position 56, also serves as means for biasing the coacting surface 60, i.e., the side 102, of the generally U-shaped member 98, against the cam surface 42 defined by the roller 44.

The first lever 110 has a second end portion 124 to which the spring 64 is attached. The second end portion 124 of the first lever 110 also defines a generally flat surface 126 facing generally in an opposite direction from the spring 64. A second lever 128 also forms a part of the second link structure 52. This second lever 128 is secured to a pivot shaft 130 of the control valve 8 for actuation of the cylinder 20. The second lever 128 has an end portion 132 having a generally flat surface 134 which contacts the generally flat surface 126 on the second end portion 124 of the first lever 110. Thus, as the first lever 110 rotates about its pivot point 58, the second lever 128 is likewise rotated. In response to rotation of the second lever 128, a signal is sent to the detent release control means of the valve 8. A structure which accomplishes this can be that shown in previously mentioned U.S. Pat. No. 4,020,963, or can be any of a number of relatively simple structures which form no part of the present invention. It is noted that the internal spring loading of the valve 8 serves to bias the generally flat surface 134 of the second lever 128 against the generally flat surface 126 of the first lever 110. Thus, the surfaces 126 and 134 are kept in contact. The detent release control means, in the conventional manner and as set out in the previously mentioned U.S. Pat. No. 4,020,963, stops the automatic retraction of the rod 22 which, in the preferred embodiment, thereby stops the rack-back of the bucket 14 at the desired point.

INDUSTRIAL APPLICABILITY

The apparatus 19 of the present invention is particularly useful with a conventional loader vehicle 10 of the nature illustrated in FIG. 1. Basically, a linkage 30 is provided which will sense a given length of a telescoping tilt cylinder 20 which is also pivotally attached to the vehicle 10 at a pivot axis 21 and wherein the linkage 30 will transfer a mechanical signal across the pivot axis 21 of the tilt cylinder 20 to the frame 11 within the limits of the operative pivot angles of the tilt cylinder 20, regardless of the cylinder angular attitude. Very easy adjustability is provided. Further, a roller 44 can be adjusted over the pivot axis 21 of the cylinder 20 to the frame 11, generally only a few millimeters, to provide insensitivity to a limited degree of wear of the components of the linkage 30. The prior art sliding contact between the adjusting bolt and a lever, which promotes binding of the linkages, is eliminated. Because of the capability of adjusting the roller 44 over the center of the pivot axis 21 of the cylinder 20 to the frame 11, additional force is provided for kickout after the desired kickout position is reached.

Other aspects, objects and advantages of this invention can be obtained from a study of the drawings, the disclosure and the appended claims.

I claim:

1. In an apparatus (19) having first (20) and second (11) members (20, 11) pivotally mounted relative to one another about a pivot axis (21), said first member (20) having first (32) and second (34) operating conditions, and having linkage means (30) for transmitting a mechanical signal across said pivot axis (21), said linkage means (30) having a first link structure (36) pivotally mounted relative to said first member (20) and defining a generally circular cam surface (42), said first link structure (36) being pivotable to first (48) and second (50) positions (48, 50) relative to said first member (20) and a second link structure (52) having first (54) and second (56) positions (54, 56) and being pivotally mounted relative to said second member (11), said second link structure (52) defining a coacting surface (60) which said cam surface (42) contacts with said first link structure (46) in its first position (48) to define said first position (54) of said second link structure (52), means (62) for moving said second link structure (52) to its second position (56) in response to movement of said first link structure (36) to its second position (50) and mechanical signal originating means (66) for moving said first link structure (36) to its first (48) and second

(50) positions (48, 50) in response to said first member (20) being respectively in said first (32) and second (34) operating conditions (32, 34), the improvement comprising:

a roller (44) having a center (88) and being mounted at said center (88) to said first link structure (36), said roller (44) defining said cam surface (42);

a generally U-shaped member (98) having a pair of legs (100, 102) having outfacing sides (104, 106) and being mounted to said second link structure (52), one (106) of said outfacing sides (104, 106) defining said coating surface (60); and means (122) for adjusting said one side (106) of said generally U-shaped member (98) tangentially and radially relative to said roller (44).

2. The apparatus (10) as set forth in claim 1, wherein said means (62) biases said coacting surface (60) against said cam surface (42).

3. The apparatus (19) as set forth in claim 1, wherein said second link structure (52) includes a first lever (110) generally centrally pivotally mounted to said second member (11), said first lever (110) having a first end portion (108) to which said generally U-shaped member (98) is mounted and a second end portion (124), and a second lever (128) pivotally mounted to said second member (11), said second lever (128) having an end portion (132) positioned in sliding contact with said second end portion (124) of said first lever (110).

4. The apparatus (19) as set forth in claim 1, further including:

means (86) for adjusting said first link structure (36) relative to said first member (20) for positioning said center (88) of said roller (44) a selected distance over said pivot axis (21).

5. The apparatus (19) as set forth in claim 4, wherein said first link structure (36) includes a first link (36) centrally pivotally mounted relative to said first member (20), said first link (36) having first (46) and second (82) end portions (46, 82), wherein said roller (44) is mounted to said first end portion (46) of said first link (36) and wherein said means (86) includes a connecting rod structure (80) connected to act relatively between said second end portion (82) of said first link (36) and said first member (20) and means (90,94) for selectively adjusting said connecting rod structure (80) to a selected length.

6. The apparatus (19) as set forth in claim 1, wherein said first member (20) is a cylinder (20) having an extendable rod (22), said first operating condition (32) corresponds to having at least a selected fraction of said rod (22) within said cylinder (20) and said second operating condition (34) corresponds to having less than said selected fraction of said rod (22) within said cylinder (20).

7. The apparatus (19) as set forth in claim 1, wherein said U-shaped member (98) is constructed of a spring plate material and wherein said means (122) includes a slot (112) through the other (100) of said legs (100, 102) and an adjusting screw (114) in threaded engagement relative to said other leg (100) and in contact with said one (102) of said legs (100, 102) having said one side (106).

* * * * *